United States Patent [19]

Blasczyk et al.

[11] Patent Number: 4,783,011

[45] Date of Patent: Nov. 8, 1988

[54] METHOD AND APPARATUS FOR THE TWO-STAGE CRUSHING OF BRITTLE MATERIAL FOR GRINDING

[75] Inventors: Gotthardt Blasczyk; Norbert Patzelt; Heinz-Georg Mersmann, all of Beckum; Franz J. Adrian, Lippetal; Hardy Kropf, Oelde, all of Fed. Rep. of Germany

[73] Assignee: Krupp Polysius AG, Fed. Rep. of Germany

[21] Appl. No.: 131,035

[22] Filed: Dec. 10, 1987

[30] Foreign Application Priority Data

Dec. 23, 1986 [DE] Fed. Rep. of Germany ..... 3644341

[51] Int. Cl.[4] ..... B02C 25/00

[52] U.S. Cl. ..... 241/24; 241/29; 241/35; 241/80; 241/152 A

[58] Field of Search ..... 241/152 A, 34, 29, 24, 241/35, 79.1, 80, 97

[56] References Cited

U.S. PATENT DOCUMENTS 4,690,335 9/1987 Allers et al. ..... 241/29 X 4,726,531 2/1988 Strasser ..... 241/152 A X

*Primary Examiner*—Mark Rosenbaum

*Attorney, Agent, or Firm*—Learman & McCulloch

[57] ABSTRACT

A method and apparatus for the two-stage crushing of brittle material comprising a roll mill and a mill connected downstream thereof, the output of the second mill being delivered to a sifter in which a second branch stream of the grit obtained in the sifting operation is returned to the roll mill and a further branch stream is returned to the second mill. A first control circuit keeps the sum of the quantity of fresh material and the quantity of grit constant, while a second control circuit divides the quantity of grit into two branch streams in such a way that the drive power of the roll mill remains constant.

8 Claims, 1 Drawing Sheet

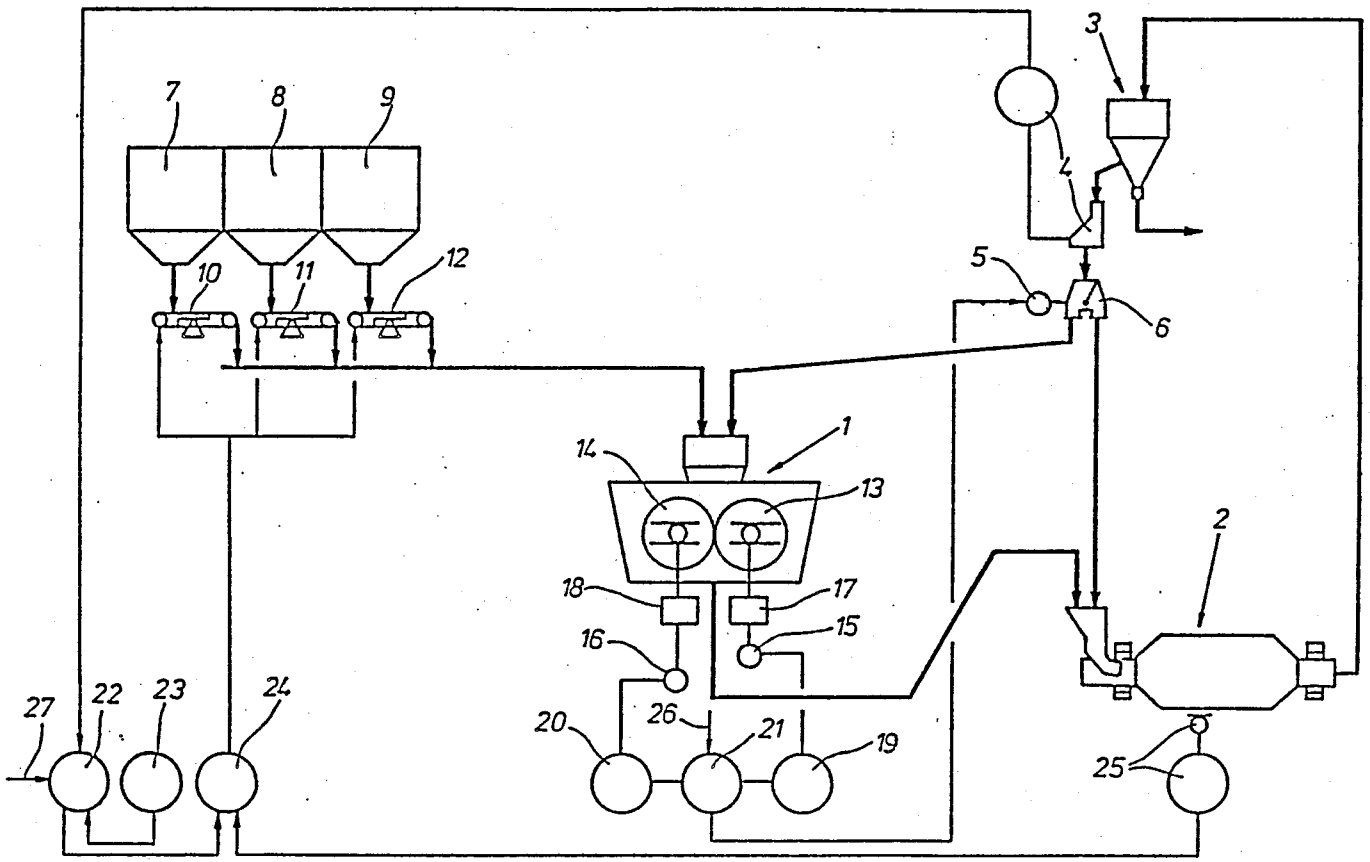
1
2
3
4
5
6
7
8
9
10
11
12
13
14
15
16
17
18
19
20
21
22
23
24
25
26
27

METHOD AND APPARATUS FOR THE TWO-STAGE CRUSHING OF BRITTLE MATERIAL FOR GRINDING

The invention relates to a method and apparatus for the two-stage crushing of brittle material that subsequently is to be ground.

BACKGROUND OF THE INVENTION

A method and apparatus of the general type to which the invention relates are the subject matter of German Patent Application No. P 35 20 069.3. In this earlier method and apparatus the branch stream of grit delivered to the roll mill is of such a quantity that an almost constant material level is maintained in the delivery shaft of the roll mill even when the quantity of fresh material changes.

The object of the invention is to provide an improved method and apparatus which enables in such a system the highest possible saving of energy and the lowest possible specific power requirement for crushing the material.

THE DRAWING

The single drawing FIGURE is a schematic illustration of one embodiment of the invention.

DETAILED DESCRIPTION

The illustrated apparatus for the two-stage crushing of brittle material, for example cement clinker, includes a first or roll mill 1 and a second mill 2 downstream of the roll mill 1 and which is preferably constructed as a ball mill.

The apparatus also includes a sifter 3 for sifting the material discharged from the second mill 2 to product grit and a finished product.

Measuring apparatus 4 is also provided for determining the quantity of grit obtained in the sifting operation. A regulating valve 6 provided with a motor 5 is connected to the measuring apparatus 4 and serves to divide the quantity of grit obtained in the sifting operation into one branch stream which is delivered to the roll mill 1 and one branch stream which is delivered to the second mill 2.

The material which is to be crushed is located in storage vessels 7, 8, 9 (which are for example associated with individual components). It is delivered to the roll mill 1 by means of dosaging conveyor-type weighers 10, 11, 12.

The roll mill 1 contains two rolls 13, 14 of which the roll 13 is constructed as a fixed roll and the roll 14 as a releasable roll. The two rolls are pressed against one another at a high pressure and are driven by electric motors 15, 16 via gear units 17, 18.

Measuring apparatus 19 and 20 determine the electrical drive power taken up by the electric motors 15 and 16 respectively. An arrangement 21 is also provided which is connected to the measuring apparatus 19, 20 and in each case selects the higher of the two measured power values. The arrangement is connected using control technology to the motor 5 of the regulating valve 6.

The measuring apparatus 4, which determines the total quantity of grit obtained in the sifting operation, is connected to a regulator 22 which receives a signal from a summation element 23 corresponding to the quantity of fresh material just delivered (the sum of the quantities of material taken from the storage vessels 7, 8, 9). The regulator 22 is connected by a switching element 24 to the drives of the dosaging conveyor-type weighers 10, 11, 12.

Finally, the apparatus also contains known monitoring means 25 which is also connected to the switching element 24 and serves to monitor the level of material in the second mill 2.

The apparatus functions as follows:

The material which is delivered to the roll mill 1 undergoes material bed crushing in the roll gap of the roll mill and at the same time, at the appropriate grain size, undergoes individual grain crushing. The agglomerates obtained in the material bed crushing are broken up in the second mill 2. If required, the material undergoes further crushing in the second mill 2.

The output of from the mill 2 is sifted in the sifter 3. Of the quantity of grit obtained in this operation one branch stream is delivered via the regulating valve 6 to the roll mill 1 and a further branch stream is delivered via the regulating valve 6 to the mill 2.

By means of a first control circuit which contains the measuring apparatus 4 and the regulator 22 the quantity of fresh material delivered to the roll mill 1 via the dosaging conveyor-type weighers 10, 11, 12 is regulated as a function of the quantity of grit obtained in the sifting operation in such a way that the sum of the quantity of fresh material and the quantity of grit for the mill 2 remains constant (27 is a theoretical value).

By means of a second control circuit which contains the measuring apparatus 19, 20 and the regulating valve 6 the quantity of grit obtained in the sifting operation is divided into branch streams which are delivered to the roll mill 1 and the second mill 2 in such a way that the drive power taken up by the roll mill remains constant.

For this purpose the arrangement 21 in each case selects the higher of the two power values determined by the measuring apparatus 19, 20 and uses it to control the motor 5 of the regulating valve 6 (26 is a theoretical value).

If the material level in the mill 2 exceeds a maximum value, the monitoring means 25 passes a signal to the switching element 24 and interrupts the control of the quantity of fresh material which takes place as described above as a function of the quantity of grit until the filling level of material in the mill 2 has returned to normal.

In the method described above the roll mill 1 runs at constant power in normal operation and is operated at a constant speed.

We claim:

1. In a two-stage method of crushing fresh brittle material wherein said material is delivered to a first power driven mill and crushed to form agglomerates, said agglomerates are delivered to a second power driven mill and further crushed to form an output that is delivered to a sifter and sifted to produce a finished product and grit, and said grit is separated into two streams the first of which is delivered to said first mill and the second of which is delivered to said second mill, the improvement comprising regulating the quantity of fresh material delivered to said first mill with reference to the quantity of grit delivered to said second mill so that the sum of the quantity of fresh material delivered to said first and the quantity of grit delivered to said second mill is substantially constant; and dividing the quantities of grit delivered to the first and second mills in such manner that the power consumption of said first mill is substantially constant.

2. The method according to claim 1 including measuring the power consumption of each of said mills and dividing the quantities of grit in accordance with the higher measured consumption value.

3. The method according to claim 1 including driving said first mill at a substantially constant speed.

4. The method according to claim 1 including monitoring the level of material in said second mill and interrupting said regulation of fresh material delivered to said first mill when the level of material in said second mill exceeds a predetermined value until said level returns to a value no greater than said predetermined value.

5. In apparatus for the two-stage crushing of brittle material having a first power driven mill, means for delivering fresh material to said first mill, a second power driven mill downstream from said first mill for receiving material from said first mill, a sifter downstream from said second mill for receiving material from said second mill and separating a finished product from grit, means for dividing said grit into two streams, and means for delivering one of said streams of grit to said first mill and the other of said streams of grit to said second mill, the improvement comprising means for measuring the quantity of grit produced by said sifter, first means for regulating the supply of fresh material to said first mill to maintain the sum of the quantity of said fresh material and the quantity of grit substantially constant; means for measuring the drive power consumed by said first mill; and second regulating means for dividing the quantities of grit contained in the respective streams of grit to maintain the power consumed by said first mill substantially constant.

6. Apparatus according to claim 5 including means for measuring the power consumed by said second mill, said second regulating means being responsive to the higher value of drive power consumed by the respective mills.

7. Apparatus according to claim 5 including means for monitoring the level of material in said second mill.

8. Apparatus according to claim 7 including switching means responsive to the level of material in said second mill exceeding a predetermined value to interrupt operation of said first regulating means until said level returns to a value no greater than said predetermined value.

* * * * *

UNITED STATES PATENT AND TRADEMARK OFFICE

CERTIFICATE OF CORRECTION

PATENT NO. : 4,783,011

DATED : November 8, 1988

INVENTOR(S) : Blasczyk et al

It is certified that error appears in the above-identified patent and that said Letters Patent is hereby corrected as shown below:

ABSTRACT, line 2, insert -- second -- after "a" (second occurrence).

ABSTRACT, line 4, cancel "second"

Column 1, line 36, change "product" to -- produce --.

Signed and Sealed this

Ninth Day of May, 1989

*Attest:*

*Attesting Officer*

DONALD J. QUIGG

*Commissioner of Patents and Trademarks*